United States Patent [19]

Heilmann et al.

[11] Patent Number: 4,867,808

[45] Date of Patent: Sep. 19, 1989

[54] HEAT TREATING A METALLIC WORKPIECE BY QUENCHING UNDER COOLING GAS UNDER ABOVE ATMOSPHERIC PRESSURE AND SPECIFIED CIRCULATION RATE

[75] Inventors: Paul Heilmann, Maintal; Friedrich Preisser, Buedingen; Rolf Schuster, Hanau, all of Fed. Rep. of Germany

[73] Assignee: Degussa Aktiengesellschaft, Frankfurt, Fed. Rep. of Germany

[21] Appl. No.: 261,927

[22] Filed: Oct. 25, 1988

[30] Foreign Application Priority Data

Oct. 28, 1987 [DE] Fed. Rep. of Germany ..... 3736501

[51] Int. Cl.[4] ..... C21D 1/74

[52] U.S. Cl. ..... 148/20.3; 148/13.1; 148/16; 148/16.7; 148/125; 148/131

[58] Field of Search ..... 148/13.1, 14, 16, 16.7, 148/20.3, 125, 131

[56] References Cited

U.S. PATENT DOCUMENTS

| | | | |
|---|---|---|---|
| 4,113,426 | 9/1978 | Rogers | 148/16.7 |
| 4,167,426 | 9/1979 | Snyder et al. | 148/16 |
| 4,302,256 | 11/1981 | Kenton | 148/13 |
| 4,571,273 | 2/1986 | Ebner | 148/16 |
| 4,612,064 | 9/1986 | Schmetz | 148/20.3 |

*Primary Examiner*—Upendra Roy

*Attorney, Agent, or Firm*—Beveridge, DeGrandi & Weilacher

[57] ABSTRACT

A process for heat treatment of metallic workpieces by heating in a vacuum furnace followed by quenching in a coolant gas under above-atmospheric pressure and with coolant-gas circulation.

5 Claims, No Drawings

HEAT TREATING A METALLIC WORKPIECE BY QUENCHING UNDER COOLING GAS UNDER ABOVE ATMOSPHERIC PRESSURE AND SPECIFIED CIRCULATION RATE

BACKGROUND OF THE INVENTION

1. Field of the Invention

The invention relates to a process for the heat treatment of metallic workpieces in a vacuum furnace by heating the workpieces and subsequently quenching them in a coolant gas under above-atmospheric pressure and with coolant-gas circulation.

2. Description of the Prior Art

Metallic workpieces, especially tools, are hardened by heating in a furnace to the austenitizing temperature of the material and then quenched. Depending on the type of material and desired mechanical properties, baths of water, oil or molten salts are necessary for quenching. Parts of high-speed steel and other high-controlled materials can also be quenched in inert gases if these are continuously cooled and circulated.

In West German Patent Nos. 2,839,807 and 2,844,843, vacuum furnaces are described in which coolant gases for quenching are passed at high gas velocity and with pressures of up to 0.6 MPa (6 bar) over the heated workpiece charges and then through heat exchangers. The necessary high coolant-gas velocities are achieved by means of nozzles or fans. Higher quenching rates can be achieved in principle by raising the coolant-gas pressure, but the gauge pressure reached with the coolant gases used at present, such as nitrogen and argon, is only up to approximately 0.6 MPa. The application of higher pressures is limited by the power of the motor which is necessary for circulation of the compressed gases. In the use of nitrogen as the coolant gas with a pressure of 0.6 MPa gauge, the necessary motor power for a fan is higher than 100 kW. However, motors with higher powers are very bulky and expensive, and are normally unsuitable for installation in a vacuum furnace.

SUMMARY OF THE INVENTION

In view of this engineering limitation on the coolant-gas circulation and the coolant-gas pressure, it was not possible heretofore to attain relatively high quenching intensities with coolant gases. As a result, the quenching process with coolant gases was limited to special materials.

An object of the present invention is to provide a process for heat treatment of metallic workpieces in a vacuum furnace by heating the workpieces and subsequently quenching them in a coolant gas under above-atmospheric pressure with coolant-gas circulation. With this method, a higher quenching intensity is achieved without having to increase the power of the motor for the coolant-gas circulation.

The object of the invention is attained by using helium, hydrogen, mixtures of helium and hydrogen or mixtures of helium and/or hydrogen with up to 30 volume percent of inert gas as the coolant gas, setting the coolant-gas pressure "p" in the furnace during quenching at values between 1 and 4 MPa and selecting the coolant-gas rate "v" such that the product p.v has a value between 10 and 250 m.MPa.sec$^{-1}$.

Preferably, helium or mixtures of helium with up to 30 volume percent of hydrogen and/or inert gases is used as the coolant gas.

It has proved favorable to set the coolant-gas pressure in the furnace during the quenching at between 1.4 and 3.0 MPa and to carry out the coolant-gas circulation with a fan.

The coolant-gas velocity "V" relates to the outlet from the coolant-gas distributing tubes.

It has been unexpected to find that with the use of helium and/or hydrogen or mixtures thereof with up to 30 volume percent of inert gas, such as nitrogen as the coolant gas, pressures up to 4 MPa can be adjusted without having to increase the motor power of the fans being used. The cooling effect of the gases is intensified in such a manner that a much broader spectrum of steels can be hardened, including such steel grades which heretofore had to be quenched in an oil bath. This high-pressure gas quenching has industrial, technical and economic advantages over liquid quenching media. Moreover, it causes less environmental pollution.

DESCRIPTION OF PREFERRED EMBODIMENTS

In the practical embodiment of this process, the steel parts are heated in a vacuum furnace which is standard for this purpose. In the process, the furnace is advantageously washed with the helium or hydrogen gas at a pressure of approximately 2 MPa at the start of heating, and the gas is circulated with a fan. This has the advantage that the heat transfer to the steel parts occurs not by radiation but by convection, which results in homogeneous heating of the charge and a considerable shortening of the heating time. Above 750° C., the gas is removed from the furnace and heating is continued under vacuum. In this temperature range, radiative heating is very effective and a protective gas is not necessary for heating of the charges. After attainment of the respective austenitizing temperature, which can lie between 800 and 1300° C., the furnace is washed with cold coolant gas with a pressure of up to 4 MPa gauge in order to cool the charge. The coolant gas is circulated by means of a fan, cooled by a heat exchanger after exiting the interior of the furnace and supplied again to the charge. This circulation is continued until the charge has been cooled. In the process, the gas velocity is adjusted by means of the fan so that the product p.v has a value between 10 and 250 m.MPa.sec$^{-1}$.

The following example is illustrative of the process of the invention:

A structural part of the low-alloy steel 100 Cr6, with a diameter of about 10 mm, is heated in a vacuum furnace to the austenitizing temperature of about 850° C. After reaching this temperature, the furnace is washed with helium to a pressure of 1.6 MPa gauge, whereby, with a gas velocity of 65 m.sec$^{-1}$, the sample was cooled to 400° C. in 16 sec, which corresponds to the cooling rate in an oil bath. A martensitic microstructural condition with a hardness of 64 HRC is obtained. The steel 100 Cr6 cannot be hardened by the gas-quenching processes known heretofore.

We claim:

1. A process for the heat treatment of metallic workpieces in a vacuum furnace by heating the workpieces and subsequently quenching them in a coolant gas under above-atmospheric pressure and with coolant-gas circulation, wherein helium, hydrogen, mixtures of helium and hydrogen or mixtures of helium and/or hydrogen with up to 30 volume percent inert gas are used as the coolant gas, the coolant gas pressure "p" in the furnace is set during the quenching at values between 1 and 4 MPa, and the coolant gas rate "v" is selected such that the product p.v has a value between 10 and 250 m.MPa.sec$^{-1}$.

2. The process as set forth in claim 1, wherein helium or mixtures of helium with up to 30 volume percent hydrogen and/or inert gases are used as the coolant gas.

3. The process as set forth in claim 1, wherein a coolant gas pressure between 1.4 and 3.0 MPa is set in the furnace during the quenching.

4. The process as set forth in claim 1 wherein the coolant gas circulation is effected with a fan.

5. The process as set forth in claim 2 wherein a coolant gas pressure between 1.4 and 3.0 MPa is set in the furnace during quenching.

* * * * *

UNITED STATES PATENT AND TRADEMARK OFFICE

CERTIFICATE OF CORRECTION

PATENT NO. : B1 4,867,808

DATED : February 22, 1994

INVENTOR(S) : Paul Heilmann et al

It is certified that error appears in the above-indentified patent and that said Letters Patent is hereby corrected as shown below:

Column 2, line 8, delete the comma "," and delete [, wherein].

Column 2, line 20 before "value' insert —a—.

Title page, after item [73] September 16, 1989 delete "September 16, 1989" and substitute —September 19, 1989—.

Signed and Sealed this

Sixth Day of December, 1994

Bruce Lehman

*Attest:*

BRUCE LEHMAN

*Attesting Officer*

*Commissioner of Patents and Trademarks*

US004867808B1

REEXAMINATION CERTIFICATE (2226th)

United States Patent [19]

[11] B1 4,867,808

Heilmann et al.

[45] Certificate Issued Feb. 22, 1994

[54] HEAT TREATING A METALLIC WORKPIECE BY QUENCHING UNDER COOLING GAS UNDER ABOVE ATMOSPHERIC PRESSURE AND SPECIFIED CIRCULATION RATE

[75] Inventors: Paul Heilmann, Maintal; Friedrich Preisser, Buedingen; Rolf Schuster, Hanau, all of Fed. Rep. of Germany

[73] Assignee: Leybold durferrit GmbH, Cologne, Fed. Rep. of Germany

Reexamination Request:
No. 90/003,135, Jul. 22, 1993

Reexamination Certificate for:

| | |
|---|---|
| Patent No.: | **4,867,808** |
| Issued: | **Sep. 16, 1989** |
| Appl. No.: | **261,927** |
| Filed: | **Oct. 25, 1988** |

[30] Foreign Application Priority Data

Oct. 28, 1987 [DE] Fed. Rep. of Germany ..... 3736501

[51] Int. Cl.[5] ..... C21D 1/00

[52] U.S. Cl. ..... 148/633; 148/634; 148/712

[58] Field of Search ..... 148/633, 634, 712

[56] References Cited

U.S. PATENT DOCUMENTS

| | | | |
|---|---|---|---|
| 3,268,371 | 8/1966 | Daubersy | 148/16 |
| 4,653,732 | 3/1987 | Wunning et al. | 266/250 |

FOREIGN PATENT DOCUMENTS

| | | | |
|---|---|---|---|
| 1919493 | 11/1970 | Fed. Rep. of Germany | F27B 5/04 |
| 2839807 | 3/1980 | Fed. Rep. of Germany | F27B 14/04 |
| 2844843 | 4/1980 | Fed. Rep. of Germany | C21D 9/00 |
| 3131142 | 3/1983 | Fed. Rep. of Germany | F27B 11/00 |
| 3315410 | 11/1984 | Fed. Rep. of Germany | C23C 11/00 |
| 0147514 | 9/1983 | Japan | 148/712 |

OTHER PUBLICATIONS

Geisser et al HTM, 42(5), Sep.-Oct. 1987, pp. 307-308, with Eng. Translation.

Conybear, Paper of Vacuum Metallurgy Conference, Jun. 20-22, 1977.

Radcliffe, E. J. Industrial Heating, Nov. 1987, pp. 34-39.

Niederman, J. M. Industrial Heating 52 (Jun.) 1985, pp. 20-23.

Tonini et al Vacuum, 31(8-9) 1981, pp. 379-383.

Cappelaere et al Nuclear Technology, 66 (Aug. 1984) 465-478.

Conybear, J. G. Adv. Materials & Proc. (Feb.) 1993, pp. 20-21.

Holoboff et al Adv. Materials & Proc. Feb. 1993, pp. 23-26.

Bauer, I. HTM 36(2) 1981, pp. 81-85 [German & English Translation].

Bauer, II ZWF 76 (1981), 8, pp. 405-410, German & English Translation.

Dawes et al Metal Progress, 100(1), Jul. 1971, pp. 72-73.

Bless VDI-Zeitschrift, 122(22), Nov. 1980, pp. 1021-1028, English Translation.

*Primary Examiner*—Upendra Roy

[57] ABSTRACT

A process for heat treatment of metallic workpieces by heating in a vacuum furnace followed by quenching in a coolant gas under above-atmospheric pressure and with coolant-gas circulation.

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 4 is cancelled.

Claim 1 is determined to be patentable as amended.

Claims 2, 3 and 5 dependent on an amended claim, are determined to be patentable.

1. [A] *In a* process for the heat treatment of metallic workpieces in a vacuum furnace by heating the workpieces and subsequently quenching them in a coolant gas under above-atmospheric pressure [and with] *by controlling*, coolant-gas circulation [, wherein] *by a motor-driven fan in said vacuum furnace, the improvement in achieving higher quenching intensity without having to increase the power of the motor for the coolant gas circulation comprising the steps of using as the coolant gas* helium, hydrogen, mixtures of helium and hydrogen or mixtures of helium and/or hydrogen with up to 30 volume percent inert gas [are used as the coolant gas], *setting* the coolant gas pressure "p" in the furnace [is set] during the quenching at values between 1 and 4 MPa, and *selecting* the coolant gas rate "v" [is selected such that the product p.v has a] *provided by the motor-driven fan having the product p.v at* value between 10 and 250 m. MPa. $sec^{-1}$.

* * * * *